United States Patent [19]

Guinn et al.

[11] 4,071,145

[45] Jan. 31, 1978

[54] PIVOTAL AND RELEASABLE RAT HOLE ASSEMBLY

[76] Inventors: David C. Guinn; Archie K. Haggard; John P. Thomas, all of P.O. Box 1126, Houston, Tex. 77001

[21] Appl. No.: 729,495

[22] Filed: Oct. 4, 1976

[51] Int. Cl.[2] ..... A47F 7/00

[52] U.S. Cl. ..... 211/60 S; 175/85

[58] Field of Search ..... 211/60 S, 60 R, 60 G, 211/99, 100, 81, 82, 170, 171, 196, 193, 63; 214/2.5; 175/85

[56] References Cited

U.S. PATENT DOCUMENTS

| | | | |
|---|---|---|---|
| 176,366 | 4/1876 | Skeel | 211/196 |
| 1,553,016 | 9/1925 | Yoder | 211/63 |
| 3,371,728 | 3/1968 | Crooke et al. | 175/85 |

*Primary Examiner*—Ramon S. Britts
*Attorney, Agent, or Firm*—Fulbright & Jaworski

[57] ABSTRACT

The rat hole assembly includes a rat hole comprised of a casing large enough to receive a kelly used in drilling of a well. The casing is perforated to permit passage of fluid when inserting or withdrawing the kelly, thus avoiding a piston effect. The rat hole is free at its upper end and includes a releasable pivot connection and support or anchor assembly at its lower end so that the upper portion of the rat hole can be swung adjacent to the rotary table used for drilling for insertion of the kelly into the rat hole and withdrawal of the kelly from the rat hole in normal drilling operations, and the rat hole, either with or without the kelly in it, can be swung over to an out of the way position when not in use.

The releasable pivot connection and support or anchor assembly preferably includes a "J" slot assembly having a pair of protective outer plates connected to a structural member and includes inner "J" slot plates. A stabber of a size to move within the inner "J" slots plate is connected to the lower end of the rat hole and includes a pin extending transversely from each side which is movable in the "J" slots.

The arrangement is such that the rat hole will not be inadvertently released from the support during normal drilling operations and storage; however, the rat hole can be released readily from the anchor when desired.

11 Claims, 4 Drawing Figures

18
16
22
26
14
20
24
41
40
10
12
28
34
34
30
34
41a
32
32
57
36
2
2
38
41

PIVOTAL AND RELEASABLE RAT HOLE ASSEMBLY

BACKGROUND OF THE INVENTION

In the rotary drilling of wells, and particularly oil and gas wells, a rotary table having an opening and kelly, which is an elongate member, flat faced in cross section, is slidable through a similarly-shaped kelly bushing secured to the rotary table and is secured to the upper end of the drill string therebelow for rotating the drill string rotary bit at its lower end during drilling. The kelly is used only during the actual drilling, and when not in use is stored in an out of the way position in what is referred to as a "rat hole." In the past, rat holes for storing the kelly have ranged from holes drilled into the ground to casing secured to a structural member of a drilling rig, for example, as illustrated in U.S. Pat. No. 3,371,728.

As the art of rotary drilling has progressed, and particularly in drilling for oil and gas in submerged offshore lands, both from fixed or floating vessels, it is highly desirable that a rat hole assembly be provided which is anchored to the drilling rig at its lower end, which rat hole is movable toward the rotary table for reception of the kelly for storing and moving to an out of the way position so that other operations may be performed without interference with the kelly, yet movable back toward the rotary for withdrawal when rotary drilling operations are to be commenced again, and which rat hole can be readily removed from the structural member when desired, for example, when moving from one location to another.

SUMMARY

Accordingly, the present invention is directed to a rat hole assembly in which the rat hole may be released and removed from the drilling rig or structure, and yet which is firmly anchored to it and its upper end may be moved toward the rotary table for reception or withdrawal of the kelly and moved to an out of the way position.

It is therefore an object of the present invention to provide a rat hole assembly which includes a releasable pivot connection and support assembly or anchor for connection to a structural support member of a drilling rig so that the upper end of the rat hole can be moved to receive a kelly for storage, moved to an out of the way position during storage, then moved back to the rotary table so that the kelly can be readily removed from the rat hole for further rotary drilling, then again moved to the out of the way position.

A further object of the present invention is the provision of such a rat hole assembly in which the releasable pivot connection and support assembly or anchor is comprised of a "J" slot and pin which is slidable in the "J" slot which coacts to provide the pivoting movement of the rat hole and releasably secures the rat hole to the anchor member.

A further object of the present invention is the provision of a releasable rat hole assembly or anchor in which the rat hole can be pivoted toward the rotary table and to an out of the way position which is relatively inexpensive and which may readily be released from the drilling rig when desired.

Other and further objects, features and advantages of the present invention will be apparent from the Abstract of the Disclosure, the Background of the Invention, this Summary, the Drawings, the Description of the Preferred Embodiments, and the claims.

DESCRIPTION OF THE PREFERRED EMBODIMENTS

Figure 1:
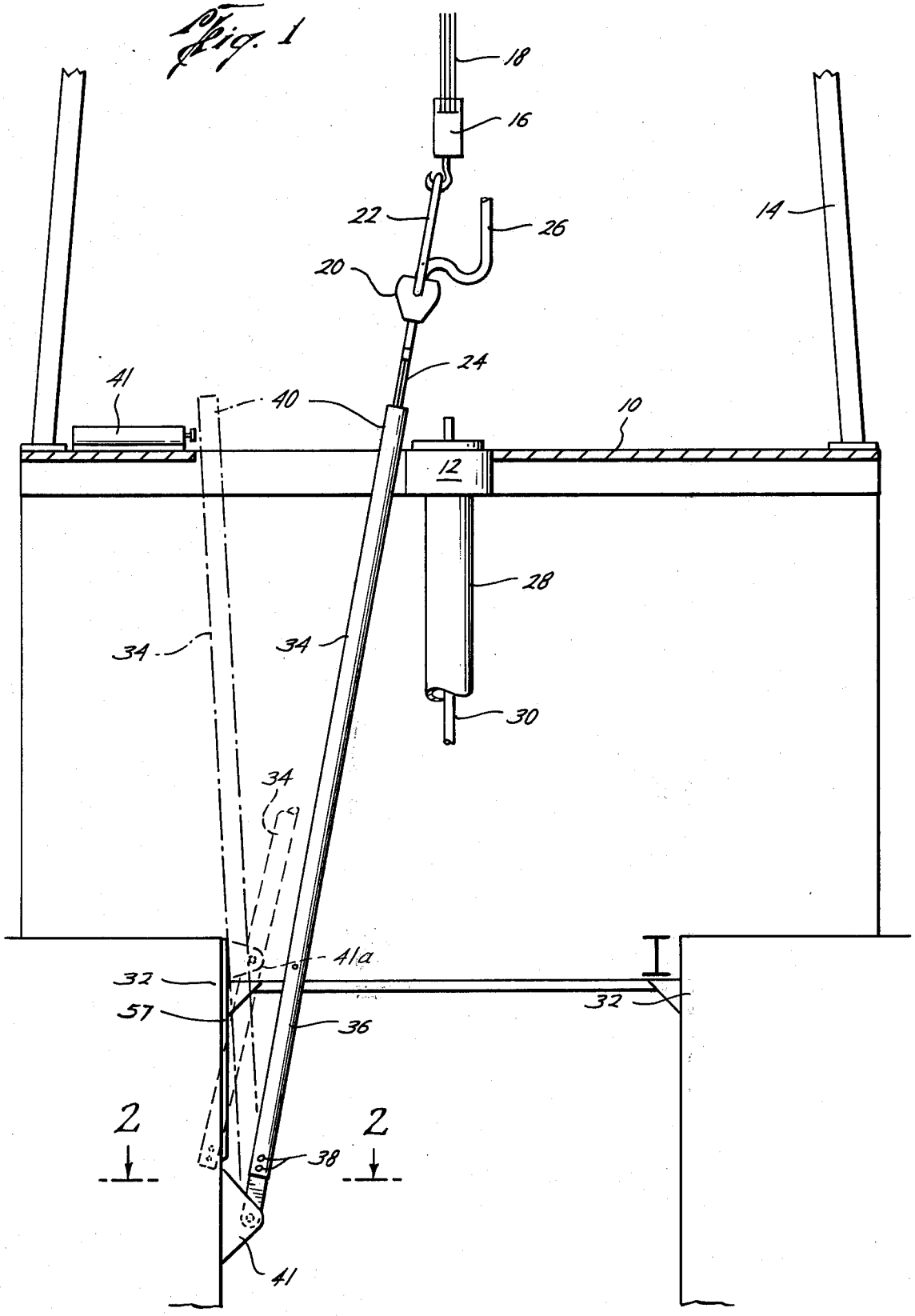
FIG. 1 is an elevational view, partly in section, illustrating a pivotal and releasable rat hole assembly or anchor according to the invention and illustrated as used with a typical drilling rig which is shown schematically.

Referring now to the drawings, and particularly to FIG. 1, a typical drilling rig is illustrated which includes the derrick floor 10 provided with the rotary table 12 and the derrick legs 14 extending up to the derrick crown, not shown. A traveling block 16 connected by the cables 18 to the crown block, not shown, includes the swivel 20 connected to the traveling block 16 by the bail 22.

Connected to the lower end of the swivel 20 is the kelly 24, which is elongated and flat faced in cross-sectional shape and which extends through a coacting kelly bushing (not shown) pinned to the rotary table 12 during drilling operations so that rotation of the rotary table 12 by means not shown rotates the kelly which in turn rotates the drill string connected therebelow. A mud line 26 is connected to the upper end of the swivel 20 for pumping mud or drilling fluid through the swivel, the kelly 24 and through the drill string during operations in the normal manner and for the usual purposes.

Conductor casing 28 is secured below the derrick floor 10 and normally extends downwardly into the formation a relatively short distance and the drill pipe 30, which is secured to the lower end of the kelly 24 as previously mentioned, extends downwardly into the well bore and has a bit attached to its lower end, not shown, so that rotary drilling operation may proceed in the normal manner.

The structural support members 32 for the drilling rig are also illustrated. In offshore drilling operations these would be on either side of what is referred to as the "moon pool," the space in which drilling operations are conducted through the drilling rig or ship.

All of the foregoing are conventional and are used in a typical rig for rotary drilling. In addition, rotary drilling rigs include means for raising and lowering the traveling block 16, rotating the rotary table, providing mud under pressure to the mud hose 26, and the like. Accordingly, no detailed description or illustration thereof if given or deemed necessary.

Figure 3:
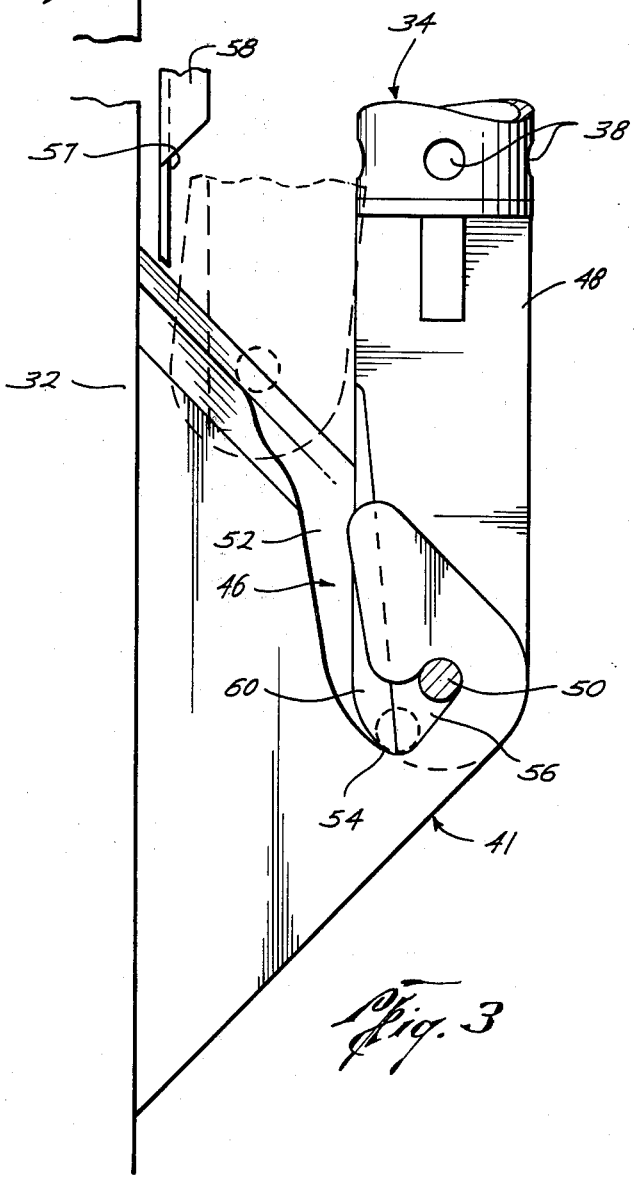
FIG. 3 is a sectional view taken along the line 3—3 of FIG. 2.
Figure 4:
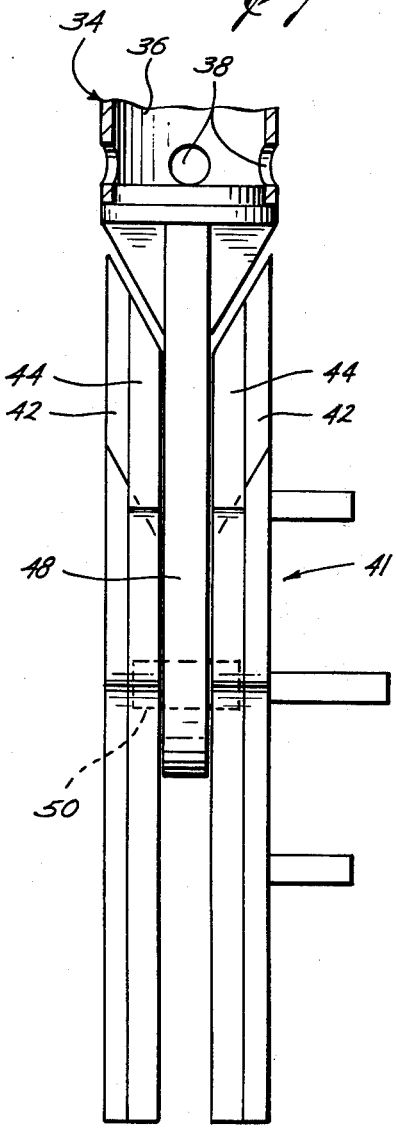
FIG. 4 is a sectional view taken along the line 4—4 of FIG. 2.

In order to protect the kelly 24 when not in use, it is highly desirable to store it in a safe place where it will not be damaged and in which it can be moved to an out of the way place so as not to interfere with operations other than drilling. The rat hole 34 is provided for this purpose and is a casing large enough to receive the kelly 24, for example, a casing of $10\frac{3}{4}$ inch O.D. and $9\frac{7}{8}$ inch I.D., although the casing may be of any size to receive the kelly 24. The rat hole should be long enough so that it will provide support for the kelly 24, the swivel 20, mud hose 26, bail 22 when stored in the out of the way position. As best seen in FIGS. 3 and 4, the lower end 36 of the rat hole 34 is provided with the perforations 38 to permit passage of fluid when inserting or withdrawing the kelly in or from the rat hole 34 to avoid a piston effect.

The upper end 40 of the rat hole is free and a releasable pivot connection and support assembly or anchor 41 are spaced from the upper end, here shown at the lower end although the pivot connection can be located other places, such as above the water line in the middle as indicated in dotted lines, so that the upper end 40 of the rat hole 34 can be swung adjacent to the rotary table 12 for insertion of the kelly 24 into the rat hole 34, as illustrated in FIG. 1, and moved to an out of the way storage position as illustrated in the dotted lines in FIG. 1, and when it is desired to reuse the kelly 24, the upper end 40 of the rat hole 34 can be swung over toward the rotary table 12, the traveling block 16 connected to the bail 22 of the swivel and the kelly 24 withdrawn. The rat hole 34 may then again be swung over into the out of the way position illustrated in dotted lines so as not to interfere with normal drilling operations.

Figure 2:
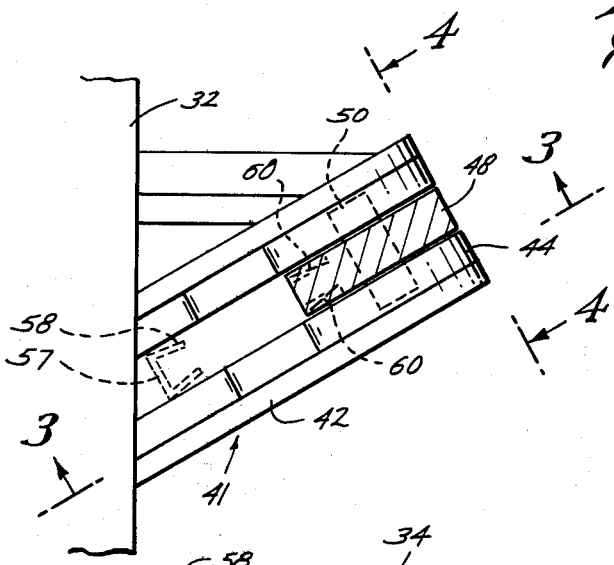
FIG. 2 is a sectional view taken along the line 2—2 of FIG. 1.

Referring now to FIGS. 2, 3, and 4 the releasable pivot connection and support assembly or anchor 41 includes a "J" slot assembly preferably having a pair of transversely spaced outer plates 42 which are secured to the structural support member 32 such as by welding, bolting and the like. A pair of inner transversely spaced plates 44 are secured to at least one and preferably both the outer plates 42 and support 32 and are provided with the coacting "J" slots 46 which generally form a "J" configuration as illustrated.

Connected to the rat hole 36 is a plate-like member 48, generally termed a stabber, which is of a width which will slide in between the inner "J" plates 44 and which has a pin 50 extending transversely from each side which is movable in the "J" slots 46 of the inner "J" plates 44. If desired, the member 38 can be omitted and the pins **50*a* connected directly to the rat hole 36 and the "J" plates are of a width sufficient for the rat hole 36** to pass between them.

The shape of the "J" slots 46 is such that the upper leg 52 is inclined upwardly and outwardly, and has a bottom portion 54 upon which the pin 50 normally rests to support the rat hole 34 and to provide a pivoting movement so that the upper end can be moved toward and away from the rotary table 12 as illustrated in FIG. 1.

Each "J" slot 46 includes the upwardly and inwardly extending leg 56 so that if the rat hole 34 is normally moved upwardly, for example when in the inclined position illustrated in FIG. 1, the pin 50 is stopped by the upper portion of the "J" and is not inadvertently released. Preferably, the "J" slot is shaped to provide a "see-saw" pivot with the pins 50 or pins **50*a***.

When it is desired to remove the rat hole 34 from the pivotal and releasable connection or anchor 40, the rat hole 34 is moved into the position illustrated in the dotted lines of FIG. 1 and gently moved upwardly so that the pin 50 moves upwardly and outwardly in the "J" slot legs 52. It should be noted that while an upward force exerted on the rat hole 34 when in the inclined storage position causes it to move upwardly in the "J" slot legs 52 and releases the rat hole 34 from its anchor assembly 40, but that when the upper end 40 of the rat hole 34 is adjacent the rotary table 12 or in even a vertical position, an upward force in withdrawing the kelly 24 will not disengage the rat hole 34 inadvertently due to the configuration of the "J" slots 46 and the coacting pin 50.

Thus, the rat hole 34 is free to pivot to and away from the rotary table 12 but it will not inadvertently release from its anchor assembly 40.

A guide 57 having the inwardly inclined sides 58 is attached to one of the structure support members 34 to which the releasable pivot and anchor connection 41 is secured and extends from above the water line down to the releasable anchor connection 41. A coacting guide shoe in the form of inwardly-tapering sides 60 is provided at the lower end of the casing 34 or on the stabber 48 which guides the lower end of the casing 34 to the "J" slot 46 where it is released and guided into the legs 52 of the "J" slot 46 in the releasable connection anchor 41. This arrangement advantageously avoids the use of a diver for engaging and releasing the lower end of the casing 34 from the releasable anchor connection 41 when it is below the water line.

While not shown, other types of quick release connections other than a "J" slot can be used, such as interlocking lugs, detents, a releasable shoe with a permanent connection, rotary lock, a releasable frame attached to the support 32 and the like. One embodiment of the invention, however, is the provision of the "J" slot and pin assembly 40 described in detail.

Accordingly, the present invention is well suited and adapted to attain the objects and ends and has the advantages and features mentioned as well as other inherent therein.

While a presently-preferred embodiment of the invention has been given for the purposes of disclosure, changes may be made which are within the spirit of the invention as defined by the scope of the appended claims.

What is claimed is:

1. A rat hole assembly for storing a kelly used in the drilling of a well comprising, an elongate casing of a size sufficient to receive and support the kelly during storing, the elongate casing being perforated adjacent its lower end to permit passage of fluid on inserting and withdrawing the kelly into or from the casing, and a releasable pivot connection and anchor assembly for connection to a structural support member pivotally and releasably connecting the lower end of the casing to the structural support member arranged so that the upper end of the casing can be pivotally moved to receive the kelly, and the casing and kelly in it can be pivotally moved to an out of the way position during storing of the kelly and when not in use, the releasable connection including means permitting the casing to be released only in the out of the way stored position.

2. The rat hole assembly of claim 1 where the releasable pivot connection and support include a "J" slot and pin movable into and out of the "J" slot for releasing the casing and pivotable in the "J" slot for the movement of the upper end.

3. The rat hole assembly of claim 2 where the releasable pivot connection and support assembly comprises a pair of transversely spaced outer plates for connection to the structural support member, a pair of transversely spaced inner plates provided with coacting "J" slots, the inner plates connected to at least one of the structural support members and the outer plates, a stabber insertable between the inner plates connected to the lower end of the casing, and the pin extending transversely at the lower end of the stabber movable in the "J" slots.

4. The rat hole assembly of claim 1 including, a guide disposed above and extending to adjacent the releasable pivot connection and anchor assembly and, a guide shoe at the lower end of the casing movable in the guide for guiding the lower end of the casing to the releasable pivot connection and anchor assembly.

5. The rat hole assembly of claim 2 including, a guide disposed above and extending to adjacent the "J" slot, and a guide shoe at the lower end of the casing movable in the guide for guiding the lower end of the casing to the "J" slot.

6. The rat hole assembly of claim 3 including, a guide disposed above and extending to the "J" slot, and a guide shoe on the stabber movable in the guide for guiding the stabber into the "J" slot.

7. The rat hole assembly of claim 1 including, means for moving the upper end of the casing.

8. The rat hole assembly of claim 1 where the casing is pivotally and releasably connected to the structural support member remote from its lower end.

9. The rat hole assembly of claim 1 where the casing is pivotally and releasably connected to the structural support member at its lower end.

10. The rat hole assembly of claim 2 where the casing is pivotally and releasably connected to the structural support member by the "J" slot and pin remote from the casing's lower end.

11. The rat hole assembly of claim 2 where the casing is pivotally and releasably connected to the structural support member adjacent the casing's lower end.

* * * * *

UNITED STATES PATENT OFFICE

CERTIFICATE OF CORRECTION

Patent No. 4,071,145 Dated January 31, 1978

Inventor(s) David C. Guinn, Archie K. Haggard, John P. Thomas

It is certified that error appears in the above-identified patent and that said Letters Patent are hereby corrected as shown below:

Column 2, line 58, change "if" to --is--

Column 3, line 17, change "and when" to --and then when--

Signed and Sealed this

*Third* Day of *October 1978*

[SEAL]

*Attest:*

RUTH C. MASON
*Attesting Officer*

DONALD W. BANNER
*Commissioner of Patents and Trademarks*